United States Patent [19]

Brunno

[11] 3,993,482

[45] Nov. 23, 1976

[54] ANTICORROSION ZINC BASED COATING MATERIAL

[75] Inventor: Roberto Brunno, Rome, Italy

[73] Assignee: Dalmine S.p.A., Milan, Italy

[22] Filed: Jan. 8, 1975

[21] Appl. No.: 539,586

[52] U.S. Cl. ..... 75/178 A; 29/196.5; 427/433

[51] Int. Cl.[2] ..... C22C 18/00

[58] Field of Search ..... 75/178 A, 178 AM; 29/196.5, 196.2; 427/433

[56] References Cited

UNITED STATES PATENTS

| | | | |
|---|---|---|---|
| 3,137,642 | 6/1964 | Johns | 75/178 A X |
| 3,245,765 | 4/1966 | Lawson | 29/196.5 |
| 3,505,042 | 4/1970 | Sievett et al. | 29/196.2 |
| 3,505,043 | 4/1970 | Lee et al. | 29/196.5 |

*Primary Examiner*—L. Dewayne Rutledge
*Assistant Examiner*—E. L. Weise
*Attorney, Agent, or Firm*—Kenyon & Kenyon Reilly Carr & Chapin

[57] ABSTRACT

A zinc based coating material useful for protecting ferrous surfaces against corrosion, also including magnesium, aluminum and chromium, wherein the percentage rato Mg/Al is between 1.5 and 5, the percentage ratio Cr/Mg is comprised between 0.03 and 0.2 and the amount of magnesium is between 1% and 5% by weight.

3 Claims, 1 Drawing Figure

ANTICORROSION ZINC BASED COATING MATERIAL

BACKGROUND OF THE INVENTION

1. Field of the Invention

The present invention relates to a zinc based coating material which is suitable for use in protecting ferrous surfaces against corrosion and to metal bodies having such a coating. More specifically, the invention can be used, for example, in protecting against corrosion the surface of steel sheets and the inner and outer surfaces of steel pipes. The coating material is in the form of a protective alloy containing zinc, magnesium, aluminum and chromium which gives good resistance to widespread corrosion, to localised corrosion occurring in systems using hot water, to the granular corrosion produced by steam at high temperature and to the corrosion resulting from any inversion in polarity with respect to a steel base layer. The coating alloy of the invention adheres well to the base layer, it has goods continuity features and a shiny and smooth surface.

2. Description of the Prior Art

It is common practice to protect ferrous surfaces against a hostile environment by coating them with a protective layer of a non-ferrous metal, for instance by immersing them in a bath of such molten non-ferrous metal. It is also known that the protection given by the coating depends on the following characteristics:

1. good adhesion to the ferrous base, that is to say a minimum number of weak regions in the base metal to coating interface;
2. continuity, i.e., a uniform thickness and good appearance;
3. good resistance to widespread corrosion for the duration of the protection required;
4. good galvanic protection;
5. that it has a minimum susceptibility to inversion in polarity with respect to a ferrous base;
6. that it is stable against localised attacks such as pitting and undershield (or crevice) corrosion;
7. that it is resistant to selective and intergranular corrosion.

Of the many non-ferrous metals used for this purpose, the most common is zinc, both for its relatively low cost and for its position with respect to iron in the electrochemical table of element. So far however, use of the known methods and alloys in providing a zinc coating only affect the problem referred to in the paragraphs numbered 1, 2, 3 and 4 above.

Thus for instance in U.S. Pat. No. 3,393,089 granted to Bethlehem Steel Company, there is described a zinc based protective alloy, containing from 25 to 70% Al for use against widespread corrosion. An alloy described in the British Patent No. 1,125,965, in the name Inland Steel, serves the same purpose and contains from 1 to 4% Mg and from 0.05 to 5% Al, it being clearly stated that the best results are obtained with about 2.5% Mg and about 4.4% Al. It is also expressly stated that such better results refer to protection against widespread corrosion.

In German Patent Application No. 2,146,376, in the name of Fredericia Galvaniseringsanstalt, there is described a process of zinc coating by means of double immersion wherein the second bath contains a zinc alloy containing 5% Al and 4% Cu or 20% Al, 5% Mg and 1% Si. Such coating is stated to be resistant to atmospheric corrosion namely to widespread corrosion. Additionally, in British Patent No. 1,057,285, in the name of Armco Steel Co. there is claimed a coating for protection against widespread corrosion containing from 0.04 to 0.35% Al and from 0.01 to 0.1% Mg, preferably from 0.1 to 0.2 Al and from 0.01 to 0.04% Mg the remainder being zinc and minor impurities. On the other hand there is a recent Czechoslovakian Publication in the name J. Teindl, translated by B.I.S.I. in August 1972 and numbered 10140 in which it is stated that it is a mistake to add magnesium to a bath for zinc coating steel because, when this is done, the coating is fragile and easily comes away from the steel base. There is also a report submitted at the 7th International Galvanizing Conference in Paris in 1964 in the name of J. J. Sebisty in which it is stated that magnesium has no positive effects on the performance of zinc based galvanizing coatings in respect of many types of corrosion.

This being the state of the art, it seemed obvious that there was no point in making any further investigations into zinc based galvanizing coatings containing magnesium.

SUMMARY OF THE INVENTION

It was therefore a great surprise to me that, during an experiment, I found that a suitable addition of magnesium to a bath containing molten zinc and aluminum enhanced the quality of the coating to such an extent that it acquired to some degree all of the seven features mentioned above upon which the protectivity of the coating is dependent, such features being obtained by putting into the zinc coating bath mixtures rather different from those indicated in the above mentioned patents and stated in them to be the best.

It is therefore an object of the present invention to provide a zinc based coating for use with ferrous surfaces having improved characteristics of resistance against widespread corrosion, localised corrosion, and selective and inter-granular corrosion, as well as reduced susceptibility to polarity inversion, good adhesion to a ferrous base, a more uniform thickness and a shiny and good appearance.

According to the present invention there is provided a zinc based coating material, for use in protecting ferrous surfaces against corrosion, said material also including magnesium, aluminum and chromium in which the percentage ratio between magnesium and aluminum is between 1.5 and 5, the percentage ratio between chromium and magnesium is between 0.03 and 0.2, and the amount of magnesium is between 1% and 5%.

DESCRIPTION OF THE PREFERRED EMBODIMENT

Figure 1:
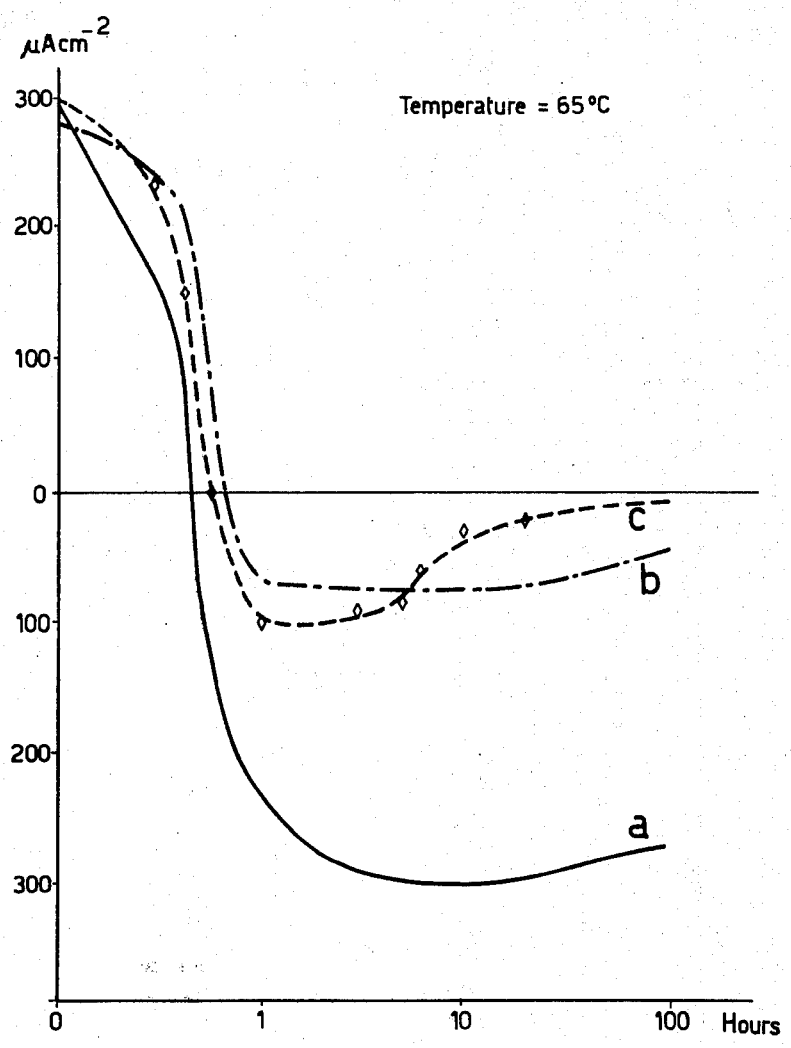

In one embodiment, the ratio between the percentages of magnesium and aluminum present is between 1.5 and 5 and preferably between 1.5 and 3, while the magnesium content is between 1 and 3%.

In another embodiment the maximum amount of aluminum allowed is 2%.

In another embodiment the magnesium content is not greater than 2%.

All the percentage values given in this specification and the claims are relatives to the molten composition contained in the bath and are given by weight. The chromium assists in increasing the resistance of the composition to corrosion, especially to inter-granular corrosion in particularly hostile environments, especially for those alloys which contain almost the maximum aluminum content allowed according to the present invention. Coatings obtained according to the present invention are much more resistant to corrosion than those previously known, as can be seen from Table 1 in which a comparison is provided between results obtained by using samples of steel sheet (2 mm. thick) and of pipes (outside diameter 21 mm. and wall thickness 3 mm.) having compositions including 0.07% C, 0.32% Mn, 0.01% P, 0.016% S, the remainder being iron and including minor impurities, such samples having been coated with zinc based alloys made in accordance with the prior art and the present invention, as indicated.

was a 0.01N solution of $NaHCO_3$ at 65° C. In one compartment as uncoated steel test piece was flushed with $CO_2$, the pH being between 5.5 and 6 approximately. In another compartment a coated test piece was flushed with $O_2$. The current intensities shown refer to the steel surface. As can be seen from the graph in FIG. 1, by using a coating alloy according to the present invention a clear decrease in the current intensity relating to the inverted pair, that is with the coating acting as a cathode and the steel acting as an anode, is achieved. It has been found that after 100 hours under test, the coating according to the present invention containing the highest amount of magnesium has a current intensity of the order of a few $\mu A/cm^2$, whereas for the zinc coating it is of the order of approximately 300 $\mu A/cm^2$.

TABLE I

| Sample No. | Contents of bath % | Thickness of coating μm | Time for inter-granular corrosion in distilled $H_2O$ vapor at 100° C by appearance of rust (Hours) | Corrosion in hot water at 65° C Loss of weight in grams per square meter after 2 months | Percent of corrosion penetration into original thickness average | max | Time for appearance of rust by exposure to salt vapor (hours) | Adherence according to UNI 5548165 UNI 5745/66 |
|---|---|---|---|---|---|---|---|---|
| 1 | Zinc | 60 | 240 (many rust spots) (1) | 9.80 | 33 | 100 | 320 | fair, very variable |
| 2 | 2.5 Mg, 4.4 Al, remainder Zn | 56 | 500 (first spots) | 4.20 | 25 | 35 | 2530 | fair |
| 3 | 1 Mg, 0.5 Al, remainder Zn | 33 | ~5000 (first spots) | 3.08 | 1 | 3 | >2600* | very good |
| 4 | 2 Mg, 0.5 Al, remainder Zn | 39 | >3000* | 3.63 | 5 | 8 | >2600* | very good |
| 5 | 5 Mg, 2 Al, remainder Zn | 50 | 1540 (first spots) | 3.34 | 15 | 20 | >2600* | good |
| 6 | 5 Mg, 2 Al, 0.2 Cr, remainder Zn | 30 | >5000* (a) | 3.41 | 10 | 15 | >2600* | good |

(1) In the case of zinc coating one is faced not so much with inter-granular corrosion but with selective penetration causing longitudinal and transverse cracks down to the steel.
*In these cases the test was stopped before any rust appeared.
(a) In this case, thickness was reduced by 60% approx., in the others (*) by 65% to 90% approx.

The contents of the water used for the corrosion tests in hot water is shown in Table II.

TABLE II

| Ion | $HCO_3^-$ | $CO_3^=$ | $NO_3^-$ | $Cl^-$ | $SO_4^=$ | $Ca^{++}$ | $Mg^{++}$ | $K^+$ | $Na^+$ |
|---|---|---|---|---|---|---|---|---|---|
| Concentration ppm | 439 | — | 0.70 | 65 | 29 | 99 | 21 | 20 | 80 |
| pH | | | 7.2 | | | | | | |

Table III shows the data referring to tests against inter-granular corrosion and corrosion caused by hot water in respect of coatings made according to the present invention.

TABLE III

| Test Series No. | Contents of bath | No. of samples | Time for inter-granular corrosion in distilled $H_2O$ vapor at 100° C by appearance of rust (hours) | Average | Corrosion in hot $H_2O$ (loss of weight gr. sq. meter) | Average |
|---|---|---|---|---|---|---|
| 1 | Zn, 1% Mg, 0.5% Al | 10 | 4360 – 5623 | 5220 | 2.00 – 3.12 | 2.6 |
| 2 | Zn, 2% Mg, 0.5% Al | 10 | 3440 – 4098 | 3672 | 3.15 – 3.80 | 3.4 |
| 3 | Zn, 5% Mg, 2% Al | 10 | 1540 – 1812 | 1640 | 3.15 – 3.95 | 3.5 |
| 4 | Zn, 5% Mg, 2% Al, 0.2% Cr | 10 | 5320 – 5800 | 5450 | 3.38 – 4.20 | 3.5 |
| 5 | Zn, 3% Mg, 2% Al,0.2% Cr | 10 | 5400 – 5968 | 5600 | 3.21 – 3.80 | 3.3 |

As far as the tendency to inversion in polarity is concerned, FIG. 1 shows a graph (a) relating to zinc coated samples, a graph (b) relating to samples coated with an alloy including 1% Mg and 0.5% Al and a graph (c) relating to samples coated with an alloy including 5% Mg and 2% Al. The measurements were carried out in cool compartment pyrex cells. The testing electrolyte If one considers the effective speed at which corrosion occurs over a steel surface which has a protective coating according to the invention, as opposed to a surface without such a coating, it will be seen that with a coating according to the present invention there would be an annual steel corrosion of the order of a few hundredths of a millimeter whereas with a simple zinc coating there would be an annual corrosion of between 3 and 3.5 mm.

As far as the resistance of the coating to localised attack from water chlorides and resistance to interstitial undershield corrosion is concerned, Table IV sets out data referring to the passivity break potential, showing that the less negative the recorded break potential the better is the resistance to localised attack, and to the amplitude of the peak of polarisation, showing that the smaller the amplitude of the peak the better is the resistance to undershield corrosion.

TABLE IV

| Type of coating | Break Potential (mV, S.H.E.) | Amplitude of passivation peak (mV) |
|---|---|---|
| Zn | −770 | 120 |
| Zn, Mg 1%, Al 0.5% | −620 | 60 |
| Zn, Mg 3%, Al 1% | −560 | 50 |
| Zn, Mg 5%, Al 2% | −570 | 60 |

The data shown in Table IV have been obtained from anode polarisation graphs obtained using water whose contents are given in Table II, at 65° C.

Contrary to the standard practice for ZN-Al coatings using the Sendzmir process, the coatings mentioned above were applied by a method involving a double immersion, first in a molten zinc bath and then in a bath of a chosen alloy.

By way of example Table V gives below data relating to the formation of slag in the path, adherence and the coating thickness determined according to UNI-5741-66 standards (Aupperle Method).

TABLE V

| Composition of coating material (second bath) % | Amount of slag and bath temp °C | Duration of immersion (seconds) | Thickness of coating (μm) Minimum | Average | Max | Adherence (UNI 5548-65) |
|---|---|---|---|---|---|---|
| Zn, Mg 1, Al 0.2 | min. 480 | 10–30 | | | | fair; a few small cracks |
| Zn, Mg 1, Al 0.5 | none;475 | 30 | 27 | 34 | 36 | very good |
| Zn, Mg 2, Al 0.5 | none;475 | 40–60 | 28 | 31 | 32 | very good slightly granular coating |
| Zn, Mg 3, Al 0.5 | large;455 | 30 | 26 | 36 | 50 | poor; very granular coating |
| Zn, Mg 3, Al 1 | none;455 | 30 | 25 | 29 | 36 | good |
| Zn, Mg 5, Al 1 | large;495 | 40 | — | — | — | nil |
| Zn, Mg 5, Al 2 | min. 495 | 10 | 40 | 43 | 45 | good |
| Zn, Mg 5, Al 2, Cr 0.15 | min. 495 | 15 | 38 | 43 | 44 | good |

As shown by the previous Tables, the best coatings of zinc alloy according to the present invention give a much higher resistance to the various types of corrosion than has been given by the coatings previously known. Resistance to widespread corrosion has been particularly improved, as can be seen from Table I, which enables the results of tests for exposures in salt vapor to be compared.

As far as inter-granular corrosion, susceptibility to inversion in polarity and resistance to localised attacks are concerned, the improved coatings according to the present invention give quite unexpected results, as compared with the known coatings.

The advantages given by the improved coatings according to the present invention are not only limited to an improved resistance to corrosion, but include ease of application. In fact coatings according to the present invention may be conveniently applied in accordance with the following method, which is already well known:- remove the grease from the ferrous piece, → pickle in HCl, → wash, → flush at 80° C in zinc and ammonium chloride → immersion in a molten zinc bath immersion in a molten bath of the alloy Zn Mg Al Cr → cooling off.

Pipes can be treated inside by the same method, a rather difficult operation when traditional methods such as Sendzmir's, or metallisation in a vacuum, or electrolytic sedimentation are used.

What I claim is:

1. A zinc based coating material, for use in protecting ferrous surfaces against corrosion, said material also including magnesium, aluminum and chromium in which the percentage ratio between magnesium and aluminum is between 1.5 and 5, the percentage ratio between chromium and magnesium is between 0.03 and 0.2, and the amount of magnesium is between 1% and 5%.

2. The coating material of claim 1 in which the ratio between the magnesium and aluminum percentage values is between 1.5 and 3 and the magnesium content is between 1% and 3%.

3. The coating material of claim 1, further comprising up to 2% aluminum.

* * * * *

UNITED STATES PATENT AND TRADEMARK OFFICE

CERTIFICATE OF CORRECTION

PATENT NO. : 3,993,482

DATED : November 23, 1976

INVENTOR(S) : ROBERTO BRUNO

It is certified that error appears in the above-identified patent and that said Letters Patent are hereby corrected as shown below:

In the name of the inventor, change "Roberto Brunno" to --Roberto Bruno--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*